US007744813B2

(12) United States Patent
Brady et al.

(10) Patent No.: US 7,744,813 B2
(45) Date of Patent: Jun. 29, 2010

(54) OXIDATION RESISTANT HIGH CREEP STRENGTH AUSTENITIC STAINLESS STEEL

(75) Inventors: Michael P. Brady, Oak Ridge, TN (US); Bruce A. Pint, Knoxville, TN (US); Chain-Tsuan Liu, Oak Ridge, TN (US); Philip J. Maziasz, Oak Ridge, TN (US); Yukinori Yamamoto, Oak Ridge, TN (US); Zhao P. Lu, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 200 days.

(21) Appl. No.: 11/619,944

(22) Filed: Jan. 4, 2007

(65) Prior Publication Data

US 2008/0163957 A1 Jul. 10, 2008

(51) Int. Cl.

| | |
|---|---|
| ***C22C 38/42*** | (2006.01) |
| ***C22C 38/30*** | (2006.01) |
| ***C22C 38/60*** | (2006.01) |
| ***C22C 38/58*** | (2006.01) |
| ***C22C 38/00*** | (2006.01) |

(52) U.S. Cl. ..... 420/34; 420/38; 420/40; 420/42; 420/45; 420/47; 420/48; 148/326; 148/327

(58) Field of Classification Search ..... None
See application file for complete search history.

(56) References Cited

U.S. PATENT DOCUMENTS

| | | | | |
|---|---|---|---|---|
| 3,826,689 | A | 7/1974 | Ohta et al. | |
| 3,865,581 | A * | 2/1975 | Sekino et al. | 420/40 |
| 3,989,514 | A | 11/1976 | Fujioka et al. | |
| 4,086,085 | A | 4/1978 | McGurty | |
| 4,204,862 | A | 5/1980 | Kado et al. | |
| 4,385,934 | A | 5/1983 | McGurty | |
| 4,530,720 | A | 7/1985 | Moroishi et al. | |
| 4,572,738 | A | 2/1986 | Korenko et al. | |
| 4,818,485 | A | 4/1989 | Maziasz et al. | |
| 4,849,169 | A | 7/1989 | Maziasz et al. | |
| 5,130,085 | A | 7/1992 | Tendo et al. | |
| 5,501,834 | A | 3/1996 | Nakasuji et al. | |
| 6,372,181 | B1 * | 4/2002 | Fahrmann et al. | 420/584.1 |
| 2004/0191109 | A1 | 9/2004 | Maziasz et al. | |

FOREIGN PATENT DOCUMENTS

| | | |
|---|---|---|
| JP | 06 248393 | * 6/1994 |
| JP | 09-324246 | * 12/1997 |

* cited by examiner

*Primary Examiner*—Melvin C Mayes
*Assistant Examiner*—Sarah Van Oudenaren
(74) *Attorney, Agent, or Firm*—Novak Druce + Quigg; Gregory A. Nelson; Gregory M. Lefkowitz

(57) ABSTRACT

An austenitic stainless steel displaying high temperature oxidation and creep resistance has a composition that includes in weight percent 15 to 21 Ni, 10 to 15 Cr, 2 to 3.5 Al, 0.1 to 1 Nb, and 0.05 to 0.15 C, and that is free of or has very low levels of N, Ti and V. The alloy forms an external continuous alumina protective scale to provide a high oxidation resistance at temperatures of 700 to 800° C. and forms NbC nanocarbides and a stable essentially single phase fcc austenitic matrix microstructure to give high strength and high creep resistance at these temperatures.

11 Claims, 6 Drawing Sheets a)

b)

c)

OXIDATION RESISTANT HIGH CREEP STRENGTH AUSTENITIC STAINLESS STEEL

STATEMENT REGARDING FEDERALLY SPONSORED RESEARCH OR DEVELOPMENT

The United States Government has rights in this invention pursuant to United States Department of Energy contract no. DE-AC05-000R22725 to UT-Battelle.

CROSS-REFERENCE TO RELATED APPLICATIONS

Not applicable.

FIELD OF THE INVENTION

The present invention relates to steel alloys particularly austenitic stainless steel.

BACKGROUND OF THE INVENTION

Common austenitic stainless steels contain a maximum by weight percent of 0.15% carbon, a minimum of 16% chromium and sufficient nickel and/or manganese to retain a face centered cubic (fcc) austenitic stainless steels crystal structure at cryogenic temperatures through the melting point of the alloy. Austenitic stainless steels are non-magnetic non heat-treatable steels that are usually annealed and cold worked. Common austenitic stainless steels are widely used in power generating applications; however, they are becoming increasingly less desirable as the industry moves toward higher thermal efficiencies by increasing the working temperatures of the generators. Austenitic stainless steels for high temperature use rely on $Cr_2O_3$ scales for oxidation protection. These scales grow relatively quickly, and do not function well in environments containing species like water vapor, sulfur, carbon, etc due to inherent limitations of the $Cr_2O_3$ scales formed on these alloys. Creep failure of common austenitic stainless steels such as types 316, 321, and 347 has limited the use of these steels at higher working temperatures.

There have been a number of approaches to improving oxidation resistance of austenitic steels for high temperature use. Moroishi et al. U.S. Pat. No. 4,530,720 describes achieving improved resistance by limiting the sulfur content to no more than 0.0035%, carbon to less than 0.1%, and manganese to less than 3%, with silicon from 0.1 to 5.0%. The sulfur content must be very low as the sulfur in an alloy concentrates at the grain boundaries inhibiting the diffusion of chromium, aluminum or silicon to the surface to maintain a protective oxide film at the surface. The C is low with any content included only to improve strength of the steel. If C is used it is preferred to add Ti, Nb, Zr, or Ta to selectively combine with the carbon. Mn is a deoxidizing agent that does not improve the resistance to oxidation. The steel is also improved by the addition of Ca, Mg, Y or rare earth metals that form stable sulfides at up to 0.1%. The silicon is included to improve the oxidation resistance as it forms a desirable oxide at the surface. Although aluminum forms a desirable oxide at the surface Al is limited to only 0.1%, which is an insufficient level to form a protective $Al_2O_3$ scale.

Tendo et al. U.S. Pat. No. 5,130,085 teaches the desirability of high Al content, with an Al content of 4 to 6%, C up to 0.2%, Mn up to 2%, Si up to 1%, Mg below 100 ppm, and Ca, Y or a rare earth metal between 30 and 50 ppm by a formulate relative to the quantity of sulfur and oxygen in the alloy. With high levels of Al, the Mg deteriorates the hot workability and is to be avoided. Masayuki teaches that the Al content had to be above 4% or an $Al_2O_3$ surface is not formed. Although these alloys form a robust $Al_2O_3$ scale, other properties such as creep resistance are inferior. Because of the high level of Al, an extremely high level of Ni is used to maintain the fcc (face center cubic) crystal structure to achieve good creep strength. Al is a strong bcc (body center cubic) phase stabilizer and the bcc polymorph of Fe exhibits poor creep resistance at 500-600° C. The high cost of Ni renders such an alloy economically unviable for many applications.

Kado et al. U.S. Pat. No. 4,204,862 discloses austenitic iron alloys that contain 4.5 to 6.5% Al to give an alumina film. Alloys with less than 4.5% Al lack an alumina film but rather form a spinel oxide surface that spalls and form internal $Al_2O_3$. Ni levels of greater than 22% are required for reasonable creep strength and with high Al levels Ni levels of approximately 37% are required for a "creep strength as high as ordinary austenitic stainless steels."

McGurty U.S. Pat. No. 4,086,085 discloses austenitic iron alloys that require 3.5 to 5.5% Al to give an alumina film. Creep resistance is not directly measured, but the patent compares the Fe-20Ni-15Cr-4.5Al alloys disclosed therein to having austenite instability when heated for long periods of time at temperatures of 1000-1200° F. (524-635° C.) and that stability can be achieved at these temperatures only upon increasing the Ni content significantly to about 35%, which significantly increases the alloy's cost. These alloys also suffered from poor hot workability. McGurty U.S. Pat. No. 4,385,934 subsequently disclosed the addition of Y up to 0.1% to provide these alloys with an improved hot workability and resistance to grain growth.

Fukjioka et al. U.S. Pat. No. 3,989,514 discloses austenitic steels with 0.5 to 2.5% Al in conjunction with relatively high levels of Si of 1.5 to 3.5% to achieve a stabilizing subscale of alumina and silica underneath a Cr-rich oxide scale rather than a continuous external alumina scale. Such a scale lacks oxidative stability at high temperatures when exposed to water vapor, C, S, etc. Alloys with both Ti and Nb in the range of 0.10 to 0.12% by weight showed a slight improvement of creep rupture strength at 800° C. relative to Type 310 steel, which has insufficient creep strength for use at high working temperatures such as 800° C.

Ohta et al. U.S. Pat. No. 3,826,689 discloses an alloy having high strength at elevated temperatures. Although Al levels up to 5 wt. % are possible, no $Al_2O_3$ scale is reported for these alloys, and no creep state is presented that show high creep strength in an alumina-forming alloy. Again a very high level of Ni is needed to maintain a fcc crystal structure with high Al levels. This structure is achieved by performing a double-heat treatment and water quenching.

Significant gains have been made in recent years in improving creep strength via control of dispersions of MC carbides and carbonitrides (M=Nb, Ti, V) and related phases at the nanoscale. These state-of-the-art alloys currently offer creep strength well above their useful limit from an oxidation standpoint. High temperature creep resistant austenitic steels have been directed to alloy compositions where ultrafine MC carbide dispersions are formed by employment of appropriate processing techniques. These unique stainless steels are described in Maziasz et al. U.S. Pat. No. 4,818,485 and Maziasz et al. U.S. Pat. No. 4,849,169 and are known as high-temperature ultrafine precipitate-strengthened (HTUPS) steels. The inclusion of titanium, vanadium, and niobium were found to give fine carbide particles that contained little chromium carbides or molybdenum carbides and resulting in steels with good creep resistance at 700° C. The creep resistance of HT-UPS steel is comparable to many Ni-based superalloys, which are too expensive for many applications. Unfortunately, the oxidation resistance of their Fe—Cr base oxides scale limits the use of these steels for many applications.

Maziasz et al. U.S. patent application Publication 2004/0191109 discloses stainless steels for improved heat resistance. In one embodiment Al can be included up to 5% by weight to provide an alumina scale. Although the use of this relatively high level of Al yields an alumina scale that provides oxidation resistance, the inclusion of a high level of Al in these alloys results in poor creep characteristics for all tested compositions with Al, as illustrated in FIG. 1 for the Al containing composition disclosed in the application. This poor creep was due to the bcc stabilizing effect of Al, which results in a duplex bcc and fcc matrix microstructure.

It is therefore remains desirable to have an austenitic stainless steel with the creep resistance of the HTUPS steels but with an oxidation resistance provided by an alumina scale. The combination of these features would permit the use of stainless steel in a number of applications that presently require nickel superalloys, or to expand or improve the performance of devices using stainless steel that are limited in their efficiency because of the temperature to which they are constrained due to the poor high temperature properties of the steel. Such applications include components in energy conversion and combustion systems (recuperators/heat exchangers), chemical and process industry components, petrochemical applications, including down-hole drilling. The alloy can be used as a structural component, or as a surface cladding/coating on a less oxidation-resistant substrate or material optimized for other properties such as ferritic stainless steels for ultra-supercritical steam, where high thermal conductivity and low thermal expansion is a critical issue.

SUMMARY OF THE INVENTION

An austenitic stainless steel HTUPS alloy, includes in weight percent: 15 to 21 Ni; 10 to 15Cr; 2 to 3.5 Al; 0.5 to 4 Mn; 1 to 3 Mo; 0.1 to 1 Si; 0.1 to 1 Nb; 0.05 to 0.15 C; less than 0.05 N; less than 0.3 of combined Ti+V; and base Fe, where the weight percent Fe is greater than the weight percent Ni, and unavoidable processing impurities of no more than 1 weight percent where the alloy forms an external continuous scale of alumina, nanometer scale sized NbC particles distributed throughout the microstructure, and a stable essentially single phase fcc austenitic matrix microstructure. The alloy can further include in weight percent: 0 to 3 Co; 0 to 0.5 Cu; 0 to 1 W; and 0 to 1 for the total of elements selected from the group of Y, La, Ce, Hf, and Zr. The alloy can further include in weight percent: 0.005 to 0.15 B; and 0.01 to 0.05 P.

An austenitic stainless steel alloy, includes in weight percent: 12 to 37 Ni; 10 to 25 Cr; 2 to 3.5 Al; 0 to 1 Nb; 0.03-0.15 C; less than 0.05 N; less than 0.3 of combined Ti+V; and base Fe, where the weight percent Fe is greater than the weight percent Ni, and unavoidable processing impurities of no more than 1 weight percent where the alloy forms an external continuous scale of alumina and a stable essentially single phase fcc austenitic matrix microstructure. The austenitic stainless steel alloy can be of the type A286 including in weight percent: 25 to 32 Ni; 14 to 16 Cr; 2 to 3.5 Al; 0.1 to 1 Nb; 0.04 C; 0 to 1 Mn; 0.1 to 1 Si; 1 to 3 Mo; 0.005 to 0.05 B; and 0.01 to 0.05 P. The alloy of the type A286 can further include in weight percent: 0 to 3 Co; 0 to 0.5 Cu; 0 to 1 W; and 0 to 1 for the total of elements selected from the group of Y, La, Ce, Hf, and Zr. The austenitic stainless steel alloy can be of the type 347 including in weight percent: 12 to 15 Ni; 14 to 18 Cr; 2 to 3.5 Al; 0.1 to 1 Nb; 0.03 C; and further including in weight percent: 0 to 1 Mn; 0.1 to 1 Si; 0 to 2 Mo; 0 to 0.15 B; and 0 to 0.05 P. The alloy of type 347 can further include in weight percent: 0 to 3 Co; 0 to 0.5 Cu; 0 to 1 W; and 0 to 1 for the total of elements selected from the group of Y, La, Ce, Hf, and Zr. The austenitic stainless steel alloy can be of the type NF709 including in weight percent: 22 to 28 Ni; 19 to 23 Cr; 2 to 3.5 Al; 0.1 to 1 Nb; 0.05 to 0.10 C; and further include in weight percent: 0 to 2 Mn; 0.1 to 1 Si; 1 to 3 Mo; 0 to 0.15 B; and 0 to 0.05 P. The alloy of type NF709 can further include in weight percent: 0 to 3 Co; 0 to 0.5 Cu; 0 to 3 W; and 0 to 1 for the total of elements selected from the group of Y, La, Ce, Hf, and Zr. The austenitic stainless steel alloy can be of the type HR120, including in weight percent: 32 to 37 Ni; 20 to 25 Cr; 2 to 3.5 Al; 0.1 to 1 Nb; 0.042; and further including in weight percent: 0 to 1 Mn; 0.1 to 1 Si; 1 to 3 Mo; 0 to 0.15 B; and 0 to 0.05 P. The alloy of type HR120 can further include in weight percent: 0 to 3 Co; 0 to 0.5 Cu; 0 to 3 W; and 0 to 1 for the total of elements selected from the group of Y, La, Ce, Hf, and Zr.

BRIEF DESCRIPTION OF THE DRAWINGS

A fuller understanding of the present invention and the features and benefits thereof will be obtained upon review of the following detailed description together with the accompanying drawings, in which.

DETAILED DESCRIPTION OF THE INVENTION

Figure 1:
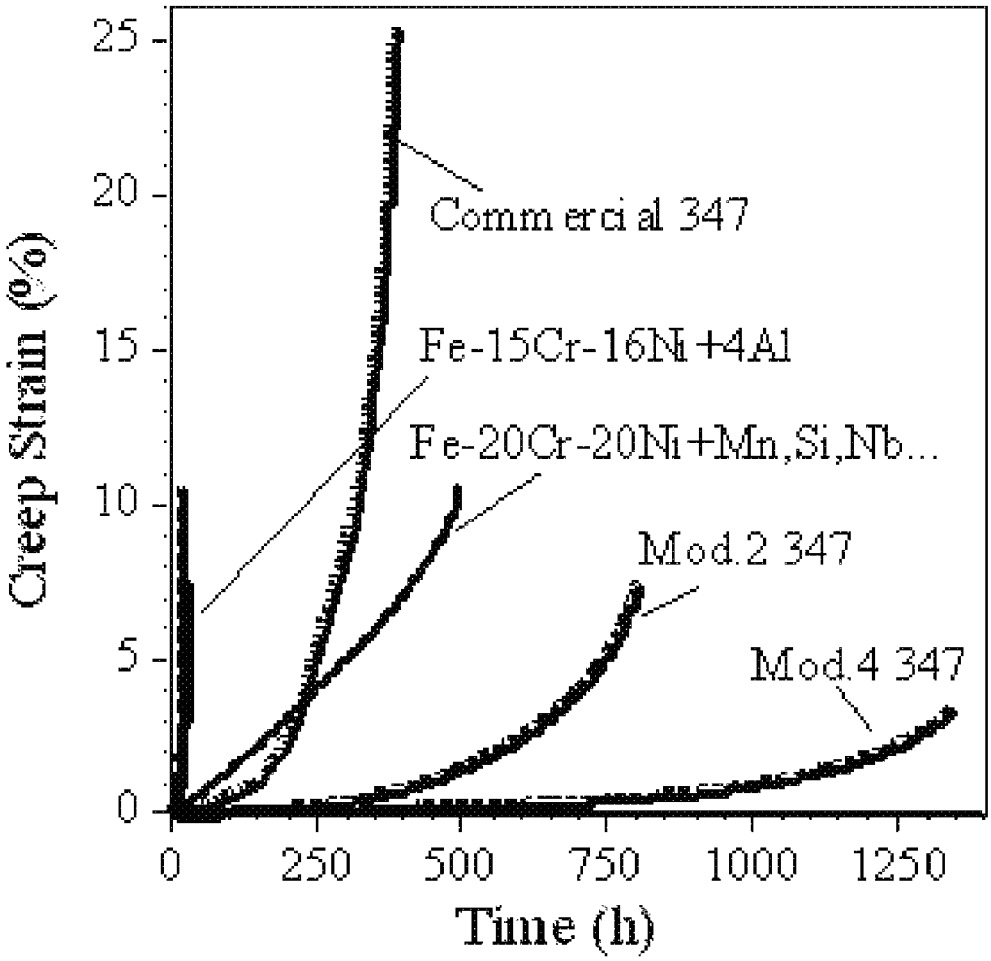
Prior Art Fig. 1
FIG. 1 shows the creep strain of prior art alloys disclosed in U.S. Patent Application No. 2004/0191109 including alloy 18528 (Fe-15Ni-16Cr-4Al) that displays poor creep resistance at 100 MPa and 750° C.

A austenitic stainless steel with an alloy base of Fe-20Ni-15Cr-(2-3.5)Al contains strengthening carbides that result in high creep resistance and an alumina scale providing high oxidation resistance. For the inventive alloys a continuous external $Al_2O_3$ scale is formed upon exposure to an elevated temperature exposure in air or other oxygen containing environments rather than a Fe—Cr or Cr base continuous oxide scale common to most austenitic stainless steel alloys. The unique alloy results when Al is included at a level of 2 to 3.5 weight percent. The strengthening carbides are NbC.

The external continuous scale comprising alumina does not form at an Al level below about 2 weight percent. At an Al level higher than about 3.7 weight percent a significant bcc phase is formed in the alloy, which compromises its high temperature properties such as creep strength. The external alumina scale is continuous at the alloy/scale interface and though $Al_2O_3$ rich but can contain some Mn, Cr, Fe and/or other metal additives in the continuous scale, such that the growth kinetics of the Al rich oxide scale is within the range of that for known alumina scale.

Niobium is included at a level of 0.1 to 1 weight percent with carbon at about 0.05 to about 0.15 weight percent such that NbC precipitates as ultrafine particles and provides the excellent creep resistance of an HTUPS alloy. The inventive alloy are used in the solution treated condition where the NbC particles not yet precipitated in combination with a small degree of cold work to introduce dislocations to act as preferential sites to aide the NbC precipitate formation as is typical for HTUPS and related heat resistant austenitic alloys. The NbC forms when the alloy is raised to an elevated temperature under structural loading or use of the alloy. It is well established that this is the preferred methodology for using high temperature alloys, and yields the best creep resistance. The precipitated NbC nano sized particles are distributed throughout the microstructure being contained within the alloy grains as well as on grain boundaries. The NbC can contain other alloying additives. A precipitation density of NbC particles in HTUPS alloys can be within the range of 1,010 to 1,017 precipitates per cubic cm.

To permit the simultaneous formation of the desired ultrafine carbide precipitates and the alumina scale the composition has to include little or no titanium or vanadium, with a combined level of less than 0.3 weight percent and be essentially free of nitrogen, with levels below 0.05 weight percent, to avoid sufficient reaction of Al with N to form coarse AlN precipitates. Within the allowable ranges of elements, particularly those of Al, Cr, Ni, Fe, Mn, Mo and, when present, Co, W, and Cu, the levels of the elements are adjusted relative to their respective concentrations to achieve a stabile fcc austenite phase. The appropriate relative levels of these elements for a composition is readily determined or checked by comparison with commercially available databases or by computational thermodynamic models with the aid of programs such as Thermo-Calc.

The inventive HTUPS alloy comprises by weight percent: 15 to 21 Ni, 10 to 15 Cr, 2 to 3.5 Al, 0.1 to 1 Nb, 0.05 to 0.15 C, 0.5 to 4 Mn, 1 to 3 Mo, 0.1 to 1 Si, 0.005 to 0.15 B, 0.01 to 0.05 P, 0 to 0.3 Ti+V, and 0 to 0.05 N, base Fe where the weight percent Fe is greater than the weight percent Ni. Additionally, up to 3 weight percent Co, up to 0.5 weight percent Cu, and up to 1 weight percent W can be present in the alloy as desired to enhance specific properties of the alloy. Rare earth and reactive elements, such as Y, La, Ce, Hf, Zr, etc., at a combined level of up to 1 weight percent can be included in the alloy composition as desired to enhance specific properties of the alloy. Other elements can be present as unavoidable impurities at a combined level of less than 1 weight percent.

The unique combination of the inventive alloy is illustrated by the following study. Alloys were prepared with the analyzed compositions that were a modification of a base HTUPS alloy as defined in P. J. Maziasz "Developing An Austenitic Stainless-Steel For Improved Performance In Advanced Fossil Power Facilities" *Journal Of The Minerals Metals & Materials Society* 41 (7) pp. 14-20 July 1989, incorporated by reference, given in Table 1, below. Initially three samples were prepared. The sample, HTUPS 1, is a control alloy with Ni levels slightly in elevation to that of base HTUPS alloys to bring the level up to that required to maintain an austenitic structure for an alloy with a significant Al content, although no Al is included. As can be seen in Table 1, the alloy also has the Ti and V levels common to the HTUPS base alloy. A second sample, HTUPS 2, has very similar quantities of all elements to that of HTUPS 1 with a small portion of the Fe substituted with Al at 2.4 weight percent. A third sample, HTUPS 3 contains an even higher level of Al of 3.7 weight percent. The alloys were manufactured by casting, solution-treated and thermo-mechanically processed at 1200° C. to produce a grain size of about 100 μm, and then cold rolled to a 10% reduction of the thickness to introduce dislocations to enhance precipitate formation. Cold rolling was carried out as this family of alloys relies on dislocations associated with cold work to act as nucleation sites for nanoscale MC carbide precipitates, M=Nb, Ti, V, which are the source of the excellent high temperature creep strength of these alloys. Plate tensile specimens with 0.5×3.2×12.7 mm at gage portion were prepared by electro-discharged machining, polished using SiC paper to a 600 grit surface finish, and then creep-rupture tested under the conditions of 750-850° C. and 70-170 MPa in air.

TABLE 1

HTUPS Compositions as Determined by Quantitative Analysis

| | Compositions (wt. %) | | | | |
|---|---|---|---|---|---|
| Element | base | 1 | 2 | 3 | 4 |
| Fe | 64.27 | 60.25 | 57.73 | 56.58 | 57.78 |
| Ni | 16 | 19.97 | 20 | 19.98 | 19.95 |
| Cr | 14 | 14.15 | 14.2 | 14.21 | 14.19 |
| Al | — | — | 2.4 | 3.67 | 2.48 |
| Si | 0.15 | 0.15 | 0.15 | 0.1 | 0.15 |
| Mn | 2 | 1.95 | 1.95 | 1.92 | 1.95 |
| Mo | 2.5 | 2.47 | 2.46 | 2.46 | 2.46 |
| Nb | 0.15 | 0.14 | 0.14 | 0.14 | 0.86 |
| Ti | 0.3 | 0.28 | 0.31 | 0.31 | — |
| V | 0.5 | 0.49 | 0.5 | 0.49 | — |
| C | 0.08 | 0.068 | 0.076 | 0.079 | 0.075 |
| B | 0.01 | 0.007 | 0.011 | 0.011 | 0.01 |
| P | 0.04 | 0.042 | 0.044 | 0.04 | 0.043 |
| Remarks | Base alloy composition (nominal) | W: 0.01 wt. % S: 30 ppm O: 70 ppm N: 170 ppm | S: 50 ppm O: 30 ppm N: 40 ppm | S: 50 ppm O: 20 ppm N: 30 ppm | Cu: 0.01 wt. % S: 30 ppm O: 20 ppm N: 50 ppm |

Figure 2:
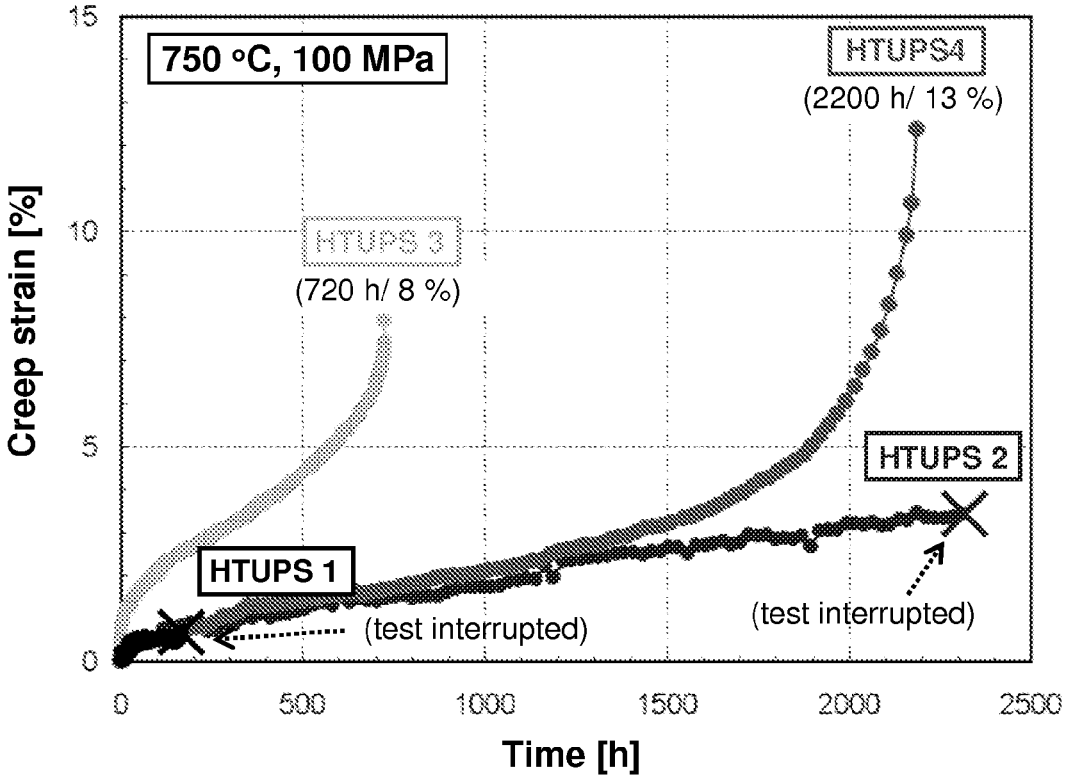
FIG. 2 shows creep curves for various test alloys at 750° C. and 100 MPa in air.

Creep curves at 750° C. and 100 MPa in air for HTUPS 1, HTUPS 2, and HTUPS 3 are shown in FIG. 2. This is an aggressive test condition, under which conventional austenitic alloys such as type 347 stainless steel alloys (Fe-18Cr-11Ni-2Mn wt. % base) rupture in less than 100 h. State-of-the-art austenitic stainless steel alloys such as HTUPS or NF709 (Fe-25Ni-20Cr-1.5Mo-1Mn wt. % base) exhibit creep rupture lives on the order of up to about 5,000 hours under this condition. The control HTUPS 1 alloy exhibits a low creep rate, consistent with the reported behavior for this class of alloys. This indicated that the increase in Ni level to 20 wt. % does not degrade properties. The HTUPS 2 also exhibits a low creep rate, indicating tolerance for 2.4 weight percent Al. However, the HTUPS 3 alloy with 3.7 weight percent Al ruptured after about 700 hours. This degradation in creep resistance compared to HTUPS 2 was linked with the formation of bcc regions in the alloy due to the relatively high Al content.

Figure 3:
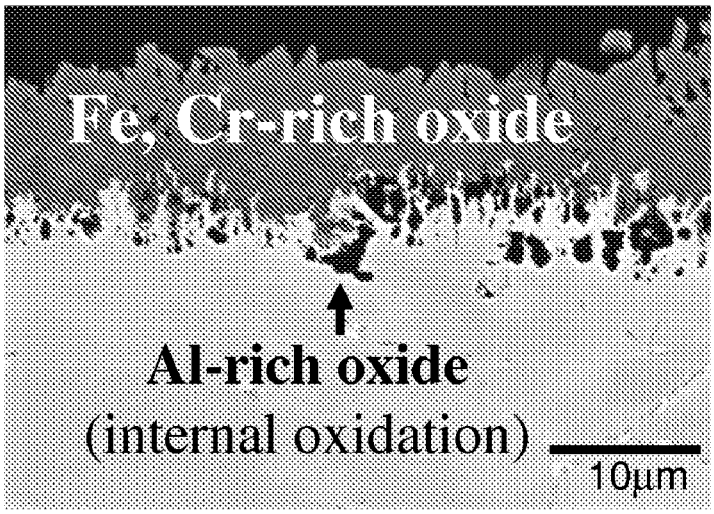
FIG. 3 shows backscatter electron images after 72 h oxidation at 800° C. in air for a) HTUPS 2, b) HTUPS 3, and c) HTUPS 4.
Figure 3:
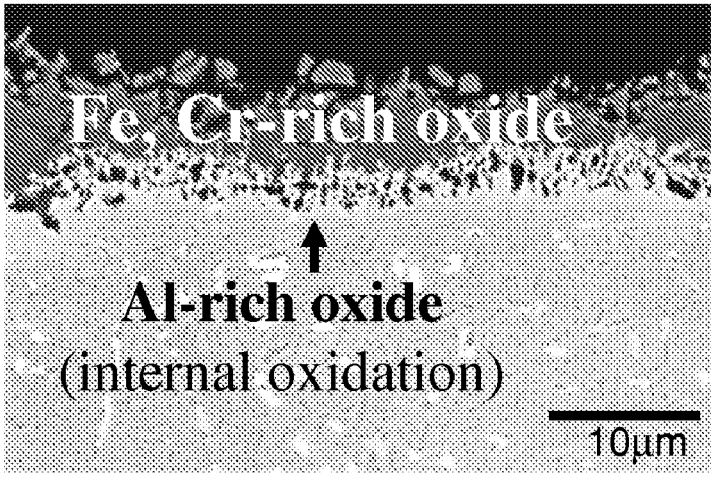
Figure 3:
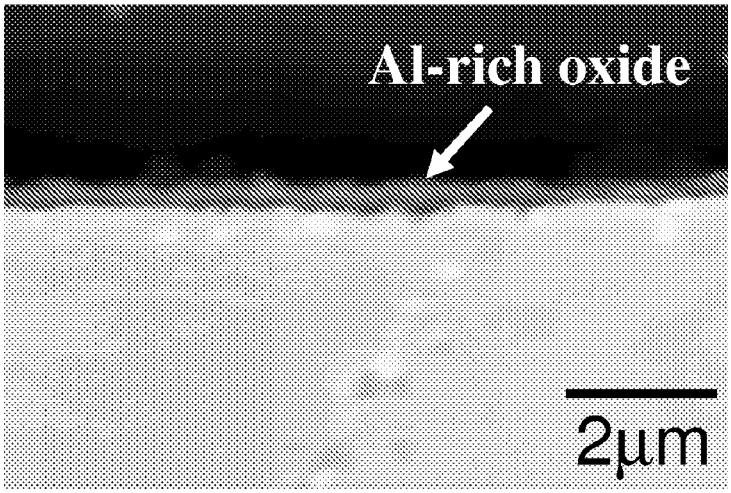

Backscattered electron cross-section micrographs of HTUPS 2 and HTUPS 3 after 72 h oxidation at 800° C. in air are shown in FIG. 3 *a*) and *b*), respectively. Neither the 2.4 nor the 3.7 weight percent level of Al addition is sufficient to impart $Al_2O_3$ scale formation in these HTUPS compositions. Rather, the Al was internally oxidized, and the external scale consisted of a relatively fast-growing mixed Fe and Cr oxide scale. An additional HTUPS alloy was prepared, HTUPS 4, with 2.4 weight percent Al but with no Ti or V additions and the level of Nb increased to compensate for the absence of Ti and V as indicated in Table 1, above. HTUPS 4 displays an excellent creep resistance at 750° C. and 100 MPa in air, as shown in FIG. 2 with a creep rupture life on the order of about 2,000 hours. Further, as shown in FIG. 3*c*, oxidation at 800° C. in air for 72 hours results in the formation of a continuous external $Al_2O_3$ based scale.

Other non-HTUPS alloys that contain Al with additions of Ti and V were prepared. These alloys did not display the ability to form a protective $Al_2O_3$ scale but rather formed Fe—Cr oxide scale similar to that shown in FIG. 2 *a*) and *b*) for the HTUPS 2 and HTUPS 3 alloys. Hence, the additions of Ti and V increases oxygen permeability in the alloy such that the Al is internally oxidized, requiring high levels of Al, levels where the high temperature strength properties are compromised by stabilization of the week bcc Fe phase, to form an external $Al_2O_3$ scale in the presence of Ti and V. The addition of Ti and/or V is common to virtually all high-temperature austenitic stainless steels and related alloys to obtain high temperature creep-strength, via precipitation of carbide and related phases. The inability to form $Al_2O_3$ scales at the lower levels of Al that allow the fcc austenitic structure is common to virtually all previous efforts to develop $Al_2O_3$-forming austenitics.

Nitrogen is generally found in austenitic alloys up to 0.5 wt. % to enhance the strength of the alloy. The nitrogen levels must be kept as low as is possible to avoid detrimental reaction with the Al and achieve the alloys of the invention that display oxidation resistance and high creep strength at high temperatures. Although processing will generally result in some uptake of N in the alloy, it is necessary to keep the level of N at less than 0.05 wt % for the inventive alloy. When N is present, the Al forms internal nitrides, which can compromise the formation of the alumina scale needed for the desired oxidation resistance as well as a good creep resistance.

Figure 4:
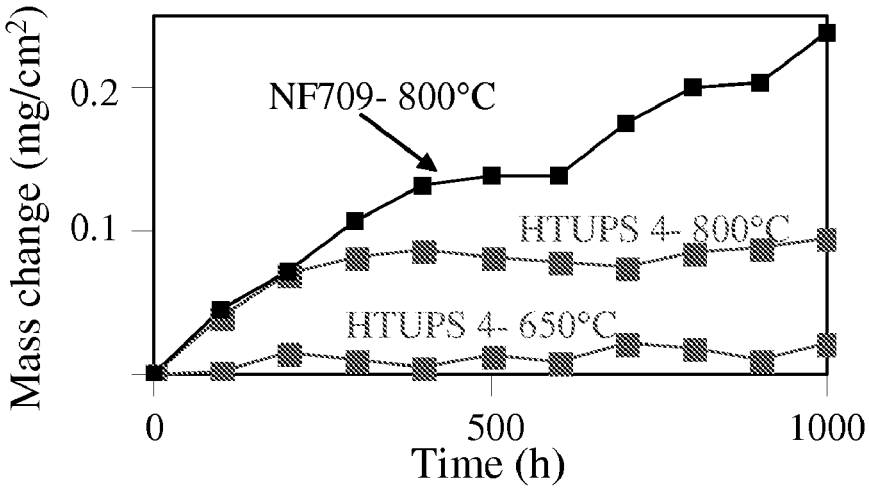
FIG. 4 shows the oxidation kinetics in air with 10% water vapor for multiple 100-hour cycles.

The oxidation resistance of HTUPS 4 was examined by the exposure of coupons at 650° C. and 800° C. in air+10% water vapor. This humid environment is extremely aggressive to conventional $Cr_2O_3$ forming austenitic alloys. Low specific mass gains, consistent with the slow oxidation kinetics of protective $Al_2O_3$ scale formation, were observed when measuring the mass change for a series of 100-hour exposure cycles, as shown in FIG. 4. The coupon surfaces were tinted at the conclusion of the tests at both 650 and 800° C., which indicated that a very thin, protective oxide scale was formed. In comparison, data for NF709 (Fe-25Ni-20Cr base), a state-of-the-art $Cr_2O_3$-forming austenitic, showed accelerated oxidation kinetics associated with volatility.

Figure 5:
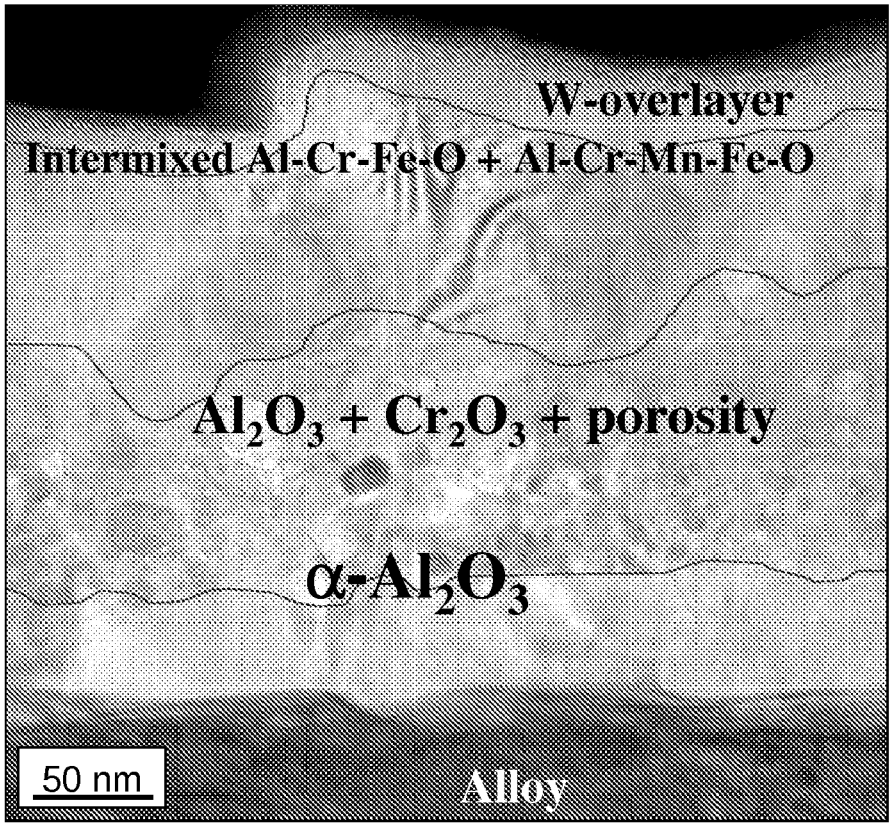
FIG. 5 shows a TEM cross-section of scale formed on HTUPS 4 after 1,000 hours in air containing 10% water vapor at 800° C.

A TEM cross-sectional view of the scale formed on HTUPS 4 after 1000 h at 800° C. in air+10% water vapor is shown in FIG. 5. The scale consisted of a 40-50 nm inner region of columnar $\alpha$-$Al_2O_3$ (width 75-100 nm) adjacent to the alloy, and an overlying 60-100 nm thick, fine-grained (<20 nm) intermixed layer of transition $Al_2O_3$+$Cr_2O_3$+porosity. In some scale regions, a 0.05-0.5 μm columnar-grained surface layer of intermixed Al—Cr—Fe—O+Al—Cr—Mn—Fe—O rich phase was also observed. Auger electron spectroscopy profiling indicated that the scale was Al-rich, with generally less than 10 atomic percent of Cr, Fe, and Si. The observed scale microstructure is consistent with the oxidation kinetics, which indicated relatively high initial transient mass gain during the first few hundred hours of exposure, followed by a transition to slow, protective oxidation kinetics.

Figure 6:
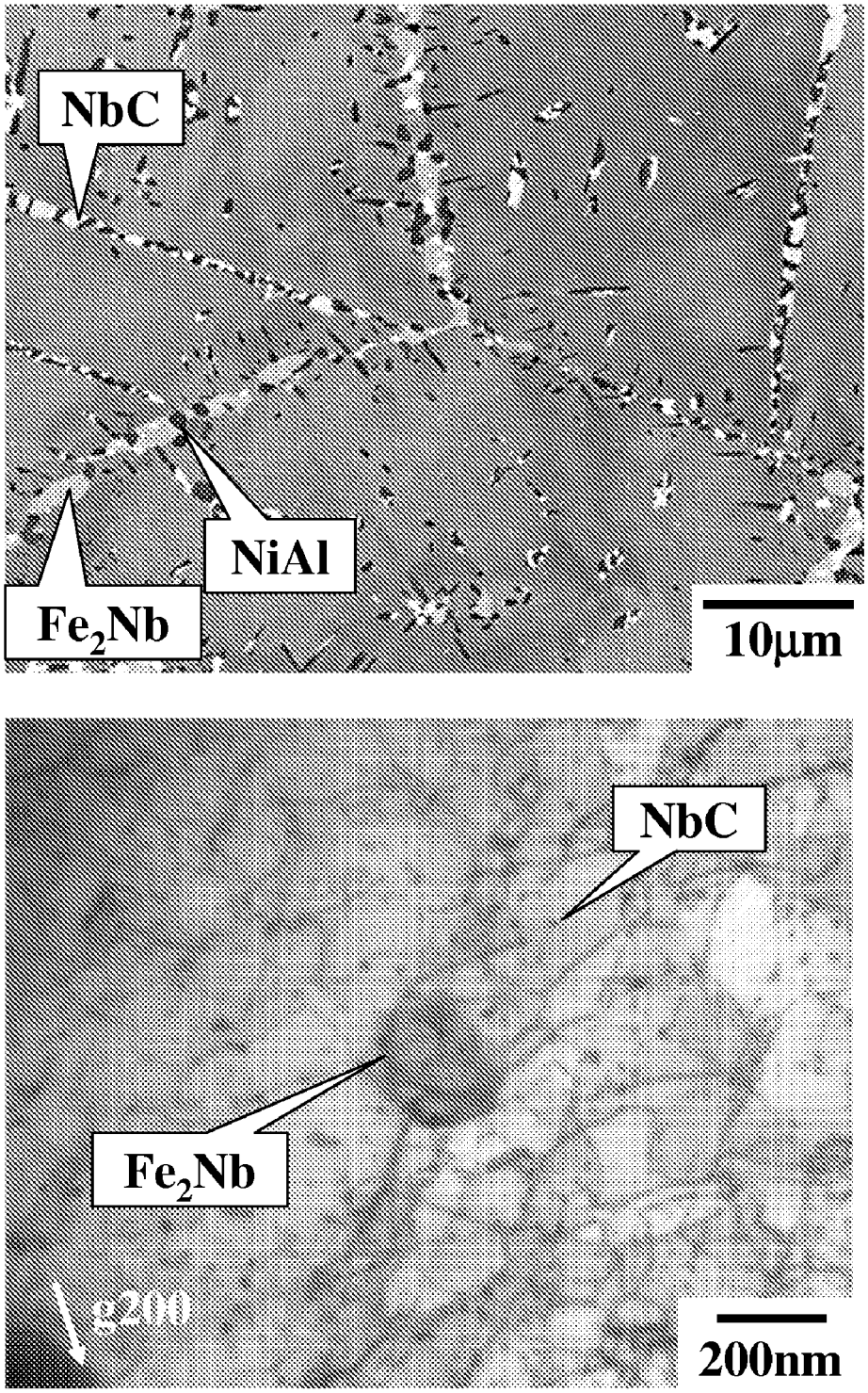
FIG. 6 displays the microstructure of HTUPS 4 after creep testing for 2,200 hours at 7590° C. and 100 MPa by a) a backscatter electron image and b) a TEM bright field.

FIG. 6 shows the microstructure of HTUPS 4 after creep rupture failure of 2,200 hours at 750° C. and 100 MPa. The alloy matrix grain boundaries were decorated with intermetallic $Fe_2Nb$ laves and NiAl phases, and coarse NbC as shown in FIG. 6*a*). The NiAl is a result of the Al additions to this alloy. The $Fe_2Nb$ laves phase and coarse NbC regions suggest that the level of Nb can be further reduced. Despite these grain boundary phases, ductility at creep rupture exceeded 13%. Well-distributed NbC carbides on the order of 10 nm were observed throughout the microstructure, as shown in FIG. 6*b*), with extensive dislocation pinning indicating that the ultrafine NbC particles were the source of the excellent creep resistance of this alloy.

Figure 7:
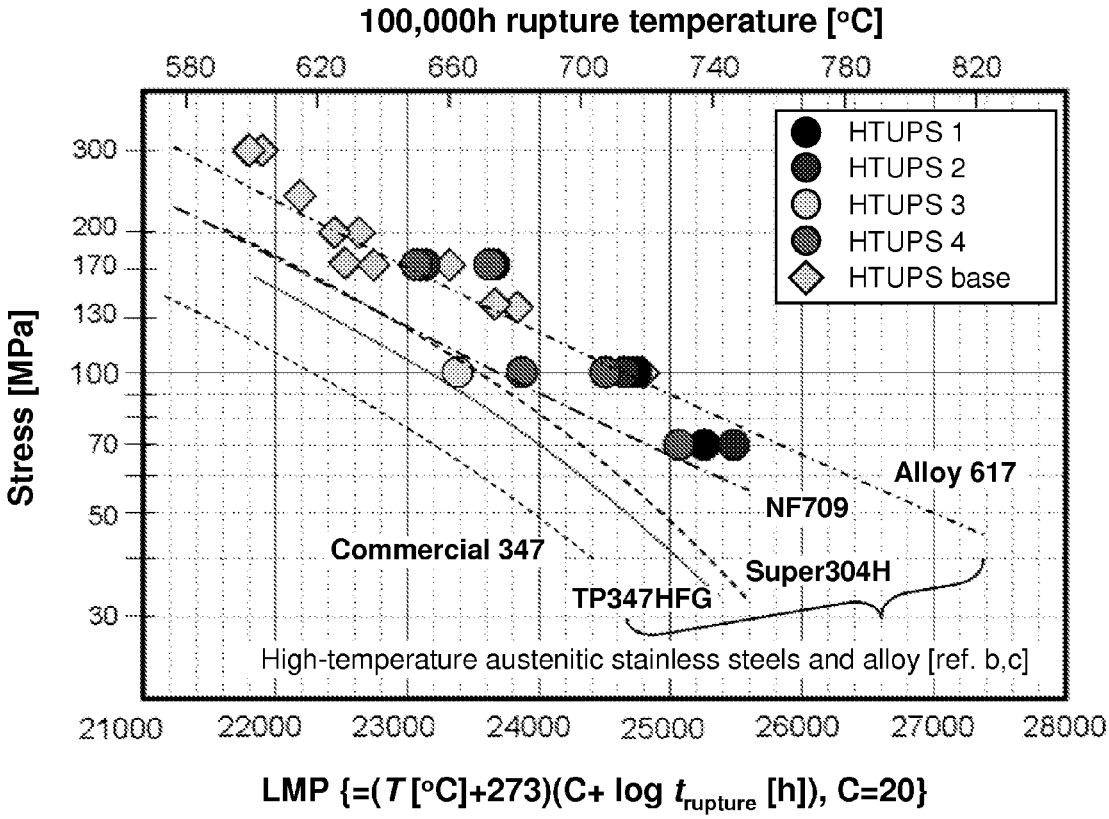
FIG. 7 shows the Larson Miller Parameter as a function of stress of HTUPS alloys and other high temperature austenitic alloys for comparison.

FIG. 7 shows a Larson Miller plot for HTUPS 4 tested between 750-850° C. and 70-170 MPa relative to current high-temperature alloys. The creep resistance of HTUPS 4 is already on the order of state-of the-art austenitics such as NF709, and the Ni-base superalloy alloy 617 (Ni-22Cr-13Co-9Mo-1Al wt. % base), but has the significant advantages of $Al_2O_3$ scale formation rather than $Cr_2O_3$, for long-term durability and higher operating temperatures under aggressive oxidizing conditions.

Preliminary assessment also indicates that the Al-modified HTUPS 4 alloy is amenable to joining by conventional welding techniques. A sample of HTUPS 4 has undergone gas tungsten arc welding resulting in no visible cracks in the alloy.

Nitrogen additions, such as those used to improve the strength of austenitic alloys such as NF709, are not viable for HTUPS 4 type alloys due to the interaction of Al with N. Reduced levels of Nb, relative to that used in HTUPS 4, to optimize NbC formation in a HTUPS alloy without also precipitating $Fe_2Nb$ Laves phase, as well as addition of elements such as Cu, W, or Co can further improve the high-temperature mechanical properties of a HTUPS alloy over those of HTUPS 4, which are excellent.

The discovery that low levels of Al are sufficient to form $Al_2O_3$ scales on fcc austenitic stainless steels when Ti and V additions are very low or absent permits the modification of other existing families of high-temperature alloys for $Al_2O_3$ scale formation in the 650-800° C. range. Compositions for modified high-temperature alloys are given in Table 2, below. Although these alloys can have an improved oxidation resistance by the modification embodiments of the invention, in general, with the exception of a modified 347 alloy, they will be less economical than the HTUPS alloy embodiment of the invention, as the proportions of Ni and Cr are higher. The alloys are strengthened with NbC carbides in the case of the HTUPS, 347, NF709, and HR120 type alloys. In the case of A286, the strength results from $Ni_3Al$ precipitates. In all cases, the Ti+V content is kept low, below 0.3 wt. %, to avoid internal oxidation of the Al, and the N content is kept very low, below 0.05 wt. %, to promote the formation of a continuous alumina rich scale. The Fe—Ni—Cr—Al levels must be adjusted within the limits of the ranges given in Table 2 to maintain the single-phase fcc matrix, in order to achieve good creep resistance.

TABLE 2

Al Modified Fe Based Austenitic Steel Alloys

| Element | HTUPS | A286 | 347 | NF709 | HR120 |
|---|---|---|---|---|---|
| | | | Weight % | | |
| Cr | 10-15 | 14-16 | 14-18 | 19-23 | 20-25 |
| Mn | 0.5-4 | 0-1 | 0-1 | 0-2 | 0-1 |
| Ni | 15-21 | 25-32 | 12-15 | 22-28 | 32-37 |
| Co | 0-3 | 0-3 | 0-3 | 0-3 | 0-3 |
| Cu | 0-0.5 | 0-0.5 | 0-0.5 | 0-0.5 | 0-0.5 |
| Al | 2-3.5 | 2-3.5 | 2-3.5 | 2-3.5 | 2-3.5 |
| Si | 0.1-1 | 0-1 | 0.1-1 | 0.1-1 | 0.1-1 |
| Nb | 0.1-1 | 0.1-1 | 0.1-1 | 0.1-1 | 0.1-1 |
| Ti + V | <0.3 | <0.3 | <0.3 | <0.3 | <0.3 |
| Mo | 1-3 | 1-3 | 0-2 | 1-3 | 1-3 |
| W | 0-1 | 0-1 | 0-1 | 0-3 | 0-3 |
| C | 0.05-0.15 | 0.04 | 0.03 | 0.05-0.10 | 0.042 |
| B | 0.01-0.15 | 0.005-0.05 | 0-0.15 | 0-0.15 | 0-0.15 |
| P | 0.01-0.05 | 0.01-0.05 | 0-0.05 | 0-0.05 | 0-0.05 |
| N | <0.05 | <0.05 | <0.05 | <0.05 | <0.05 |
| Fe | base (Fe > Ni) | base (Fe > Ni) | base (Fe > Ni) | base (Fe > Ni) | base (Fe > Ni) |

It is to be understood that while the invention has been described in conjunction with the preferred specific embodiments thereof, that the foregoing description as well as the examples, which followed are intended to illustrate and not limit the scope of the invention. Other aspects, advantages and modifications within the scope of the invention will be apparent to those skilled in the art to which the invention pertains.

We claim:

1. An austenitic stainless steel HTUPS alloy, comprising in weight percent:

15 to 21 Ni;
10 to 15 Cr;
2 to 3.5 Al;
0.5 to 4 Mn;
1 to 3 Mo;
0.1 to 1 Si;
0.1 to 1 Nb;
0.05 to 0.15 C;
less than 0.05 N;
less than 0.3 of combined Ti+V; and
base Fe, where the weight percent Fe is greater than the weight percent Ni wherein said alloy forms an external continuous scale comprising alumina, nanometer scale sized NbC comprising particles distributed throughout the microstructure, and a stable essentially single phase fcc austenitic matrix microstructure.

2. The alloy of claim 1, further comprising in weight percent:

0 to 3 Co;
0 to 0.5 Cu;
0 to 1 W; and
0 to 1 for the total of elements selected from the group of Y, La, Ce, Hf, and Zr.

3. The alloy of claim 2, further comprising in weight percent:

0.005 to 0.15 B; and
0.01 to 0.05 P.

4. An austenitic stainless steel alloy, comprising in weight percent:

10 to 25 Cr;
2 to 3.5 Al;
0 to 1 Nb;
0.03-0.15 C;
less than 0.05 N;
less than 0.3 of combined Ti+V; and
base Fe, where the weight percent Fe is greater than the weight percent Ni wherein said alloy forms an external continuous scale comprising alumina and a stable essentially single phase fcc austenitic matrix microstructure, wherein said austenitic steel alloy is an austenitic steel alloy selected from the group consisting of (i) a high nickel alloy comprising 25 to 32 wt- % Ni, (ii) an intermediate nickel alloy comprising 22 to 28 wt- % Ni, and (iii) very high nickel alloy comprising 32 to 37 Ni.

5. The alloy of claim 4, wherein the austenitic steel alloy is a high nickel alloy comprising, in weight percent:

25 to 32 Ni;
14 to 16 Cr;
2 to 3.5 Al;
0.1 to 1 Nb;
0.04 C; and further comprising in weight percent:
0 to 1 Mn;
0.1 to 1 Si;
1 to 3 Mo;
0.005 to 0.05 B; and
0.01 to 0.05 P.

6. The alloy of claim 5, further comprising in weight percent:

0 to 3 Co;
0 to 0.5 Cu;
0 to 1 W; and
0 to 1 for the total of elements selected from the group of Y, La, Ce, Hf, and Zr.

7. The alloy of claim 4, wherein the austenitic steel alloy is an intermediate nickel alloy comprising, in weight percent:

22 to 28 Ni;
19 to 23 Cr;
2 to 3.5 Al;
0.1 to 1 Nb;
0. 05 to 0.10 C; and further comprising in weight percent:
0 to 2 Mn;
0.1 to 1 Si;
1 to 3 Mo;
0 to 0.15 B; and
0 to 0.05 P.

8. The alloy of claim 7, further comprising in weight percent:

0 to 3 Co;
0 to 0.5 Cu;

0 to 3 W; and 0 to 1 for the total of elements selected from the group of Y, La, Ce, Hf, and Zr.

9. The alloy of claim 4, wherein the austenitic steel alloy is a very high nickel alloy comprising, in weight percent:

32 to 37 Ni;

20 to 25 Cr;

2 to 3.5 Al;

0.1 to 1 Nb;

and further comprising in weight percent:

0 to 1 Mn;

0.1 to 1 Si;

1 to 3 Mo;

0 to 0.15 B; and 0 to 0.05 P.

10. The alloy of claim 9, further comprising in weight percent:

0 to 3 Co;

0 to 0.5 Cu;

0 to 3 W; and 0 to 1 for the total of elements selected from the group of Y, La, Ce, Hf, and Zr.

11. The alloy of claim 10, comprising 0 to 1 for the total of elements selected from the group of Y, La, Hf and Zr.

* * * * *